US011604013B2

(12) United States Patent
Cole

(10) Patent No.: US 11,604,013 B2
(45) **Date of Patent: *Mar. 14, 2023**

(54) COOLING SYSTEM WITH SUPPLEMENTAL OIL EXTRACTION FROM REFRIGERANT

(71) Applicant: Heatcraft Refrigeration Products LLC, Stone Mountain, GA (US)

(72) Inventor: Douglas Cole, Columbus, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/403,129

(22) Filed: Aug. 16, 2021

(65) Prior Publication Data

US 2021/0372676 A1 Dec. 2, 2021

Related U.S. Application Data

(63) Continuation of application No. 16/244,804, filed on Jan. 10, 2019, now Pat. No. 11,143,444.

(51) Int. Cl.

| | |
|---|---|
| ***F25B 43/02*** | (2006.01) |
| ***F25B 31/00*** | (2006.01) |
| ***F04B 39/02*** | (2006.01) |

(52) U.S. Cl.

CPC ..... *F25B 31/004* (2013.01); *F04B 39/0207* (2013.01); *F04B 39/0284* (2013.01); *F25B 43/02* (2013.01); *F25B 2400/071* (2013.01); *F25B 2400/23* (2013.01)

(58) Field of Classification Search

CPC .... F25B 43/02; F25B 2400/23; F25B 31/004; F04B 39/0207

See application file for complete search history.

(56) References Cited

U.S. PATENT DOCUMENTS

| | | | |
|---|---|---|---|
| 4,428,208 | A | 1/1984 | Krause |
| 5,327,997 | A | 7/1994 | Nash, Jr. et al. |
| 5,901,559 | A | 5/1999 | Westermeyer et al. |
| 5,911,289 | A | 6/1999 | Waller |
| 6,263,694 | B1 | 7/2001 | Boyko |
| 7,231,783 | B2 | 6/2007 | Esslinger et al. |
| 9,488,396 | B2 | 11/2016 | Kan et al. |
| 2006/0042307 | A1 | 3/2006 | Esslinger et al. |
| 2020/0224944 | A1 | 7/2020 | Cole |

OTHER PUBLICATIONS

European Patent Office, Extended European Search Report, Application No. 19218773.0, date May 15, 2020,6 pages.

*Primary Examiner* — Lionel Nouketcha
(74) *Attorney, Agent, or Firm* — Baker Botts L.L.P.

(57) ABSTRACT

An apparatus includes a conduit coupled to a suction header that is configured to receive a refrigerant and an oil separator that is configured to separate an oil from the refrigerant received from a compressor. During a first mode of operation, the conduit is configured to remove excess oil from the refrigerant that has collected at the suction header. During a second mode of operation, the oil separator is configured to direct to the conduit the oil separated from the refrigerant received from the compressor. The conduit is configured to direct to an oil reservoir the oil from the oil separator and the excess oil removed from the refrigerant.

20 Claims, 3 Drawing Sheets

COOLING SYSTEM WITH SUPPLEMENTAL OIL EXTRACTION FROM REFRIGERANT

CROSS-REFERENCE TO RELATED APPLICATIONS

This application is a continuation of U.S. patent application Ser. No. 16/244,804 filed Jan. 10, 2019, by Douglas Cole, and entitled "Cooling System with Supplemental Oil Extraction from Refrigerant," which is incorporated herein by reference.

TECHNICAL FIELD

This disclosure relates generally to a cooling system, such as a refrigeration system.

BACKGROUND

Cooling systems are used to cool spaces, such as residential dwellings, commercial buildings, and/or refrigeration units. These systems cycle a refrigerant that is used to cool the spaces.

SUMMARY OF THE DISCLOSURE

Refrigeration systems cycle refrigerant to cool spaces, such as residential dwellings, commercial buildings, and/or refrigeration units. A typical commercial refrigeration system includes a suction header, a compressor, an oil separator, and an oil reservoir. Refrigerant enters the compressors through the suction header. The compressors compress refrigerant to concentrate the heat that has been absorbed as spaces have been cooled, making it easier for this heat to be removed from the system. Compressors typically have oiled components. As refrigerant passes through the compressor, the oil on these components mixes with the refrigerant and leaves the compressor and heads to the oil separator. The oil separator receives refrigerant from the compressor and separates most of the oil that may have mixed with the refrigerant in the compressor. By separating the oil from the refrigerant, the oil separator protects other components of the system from being clogged and/or damaged by the oil. The oil separator sends the separated oil to the reservoir so that it may be added back to the compressor as it is needed. However, the oil separator does not remove all the oil from the refrigerant and so some oil reaches the other components of the system. This oil will eventually find its way back to the suction header where it is metered back to the compressor. However, if for some reason the oil is metered back to the compressor faster than the compressor discharges it, damage can result.

This disclosure contemplates an unconventional cooling system that includes a drain leg coupled to the suction header. The drain leg uses gravity to separate and collect excess oil from the refrigerant in the suction header. During particular time intervals, the system uses the oil separated from the refrigerant in the oil separator to flush the oil collected in the drain leg to the oil reservoir. As a result, additional oil is removed from the refrigerant, which improves the lifespan of the system. Certain embodiments of the system will be described below.

According to an embodiment, an apparatus includes a suction header, a drain leg, an oil separator, and an oil reservoir. The suction header is configured to receive a refrigerant and the drain leg is coupled to the suction header. The oil separator is configured to separate an oil from the refrigerant from a compressor. During a first mode of operation, the drain leg is configured to collect an oil from the refrigerant at the suction header and the oil separator is configured to collect the oil separated from the refrigerant after the compressor. During a second mode of operation, the oil separator is configured to direct the oil separated from the refrigerant from the compressor through the drain leg and to the oil reservoir.

According to another embodiment, a system includes a high side heat exchanger, a load, a suction header, a compressor, a drain leg, an oil separator, and an oil reservoir. The high side heat exchanger is configured to remove heat from a refrigerant and the load is configured to use the refrigerant from the high side heat exchanger to cool a space proximate the load. The suction header is configured to receive a refrigerant and the compressor is configured to compress a refrigerant from the suction header. The drain leg is coupled to the suction header and the oil separator is configured to separate an oil from the refrigerant from a compressor. During a first mode of operation, the drain leg is configured to collect an oil from the refrigerant from a compressor at the suction header and the oil separator is configured to collect the oil separated from the refrigerant. During a second mode of operation, the oil separator is configured to direct the oil separated from the refrigerant from the compressor through the drain leg to the oil reservoir.

According to yet another embodiment, a method includes receiving, by a suction header, a refrigerant. The method also includes separating, by an oil separator, an oil from the refrigerant from a compressor and, during a first mode of operation, collecting, by the drain leg, an oil from the refrigerant at the suction header and collecting, by the oil separator, the oil separated from the refrigerant. The method further includes, during a second mode of operation, directing, by the oil separator, the oil separated from the refrigerant from the compressor through the drain leg to the oil reservoir.

Certain embodiments provide one or more technical advantages. For example, certain embodiments include a drain leg that uses gravity to separate and collect excess oil from the refrigerant in the suction header. As a result, additional oil is removed from the refrigerant, which improves the lifespan of the system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
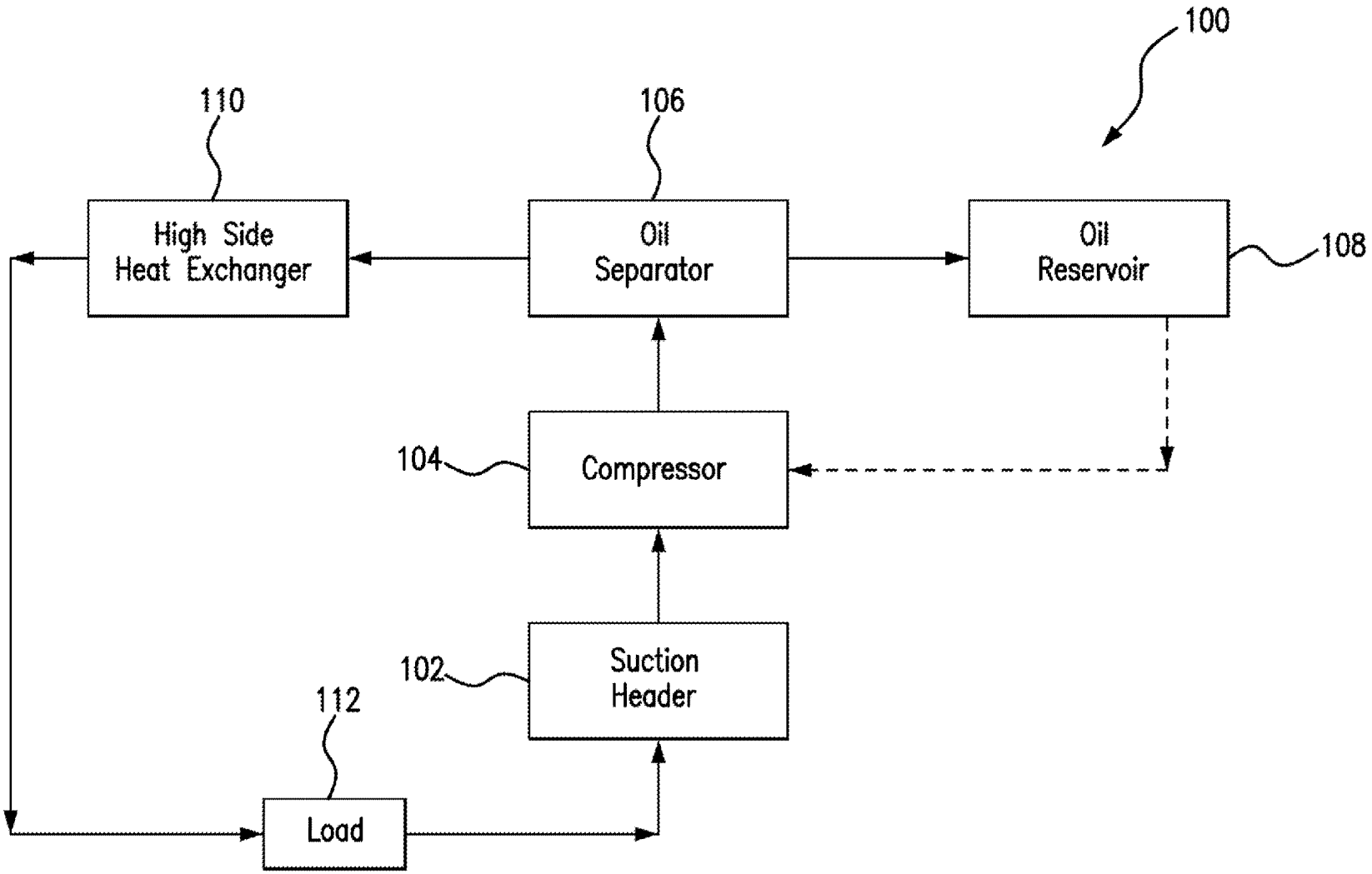
FIG. 1 illustrates an example cooling system.
Figure 2:
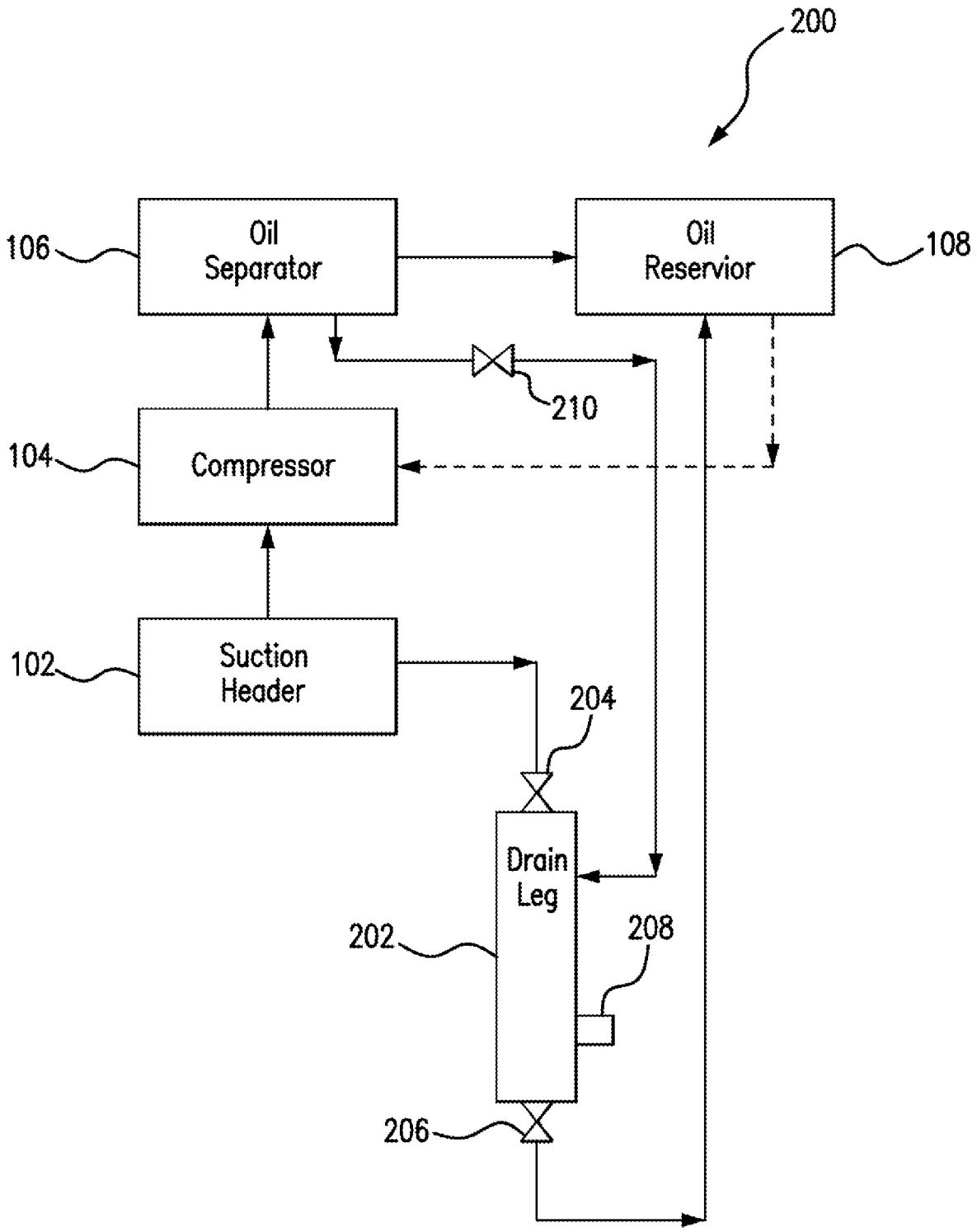
FIG. 2 illustrates the detail of the enhanced oil system of an example cooling system.
Figure 3:
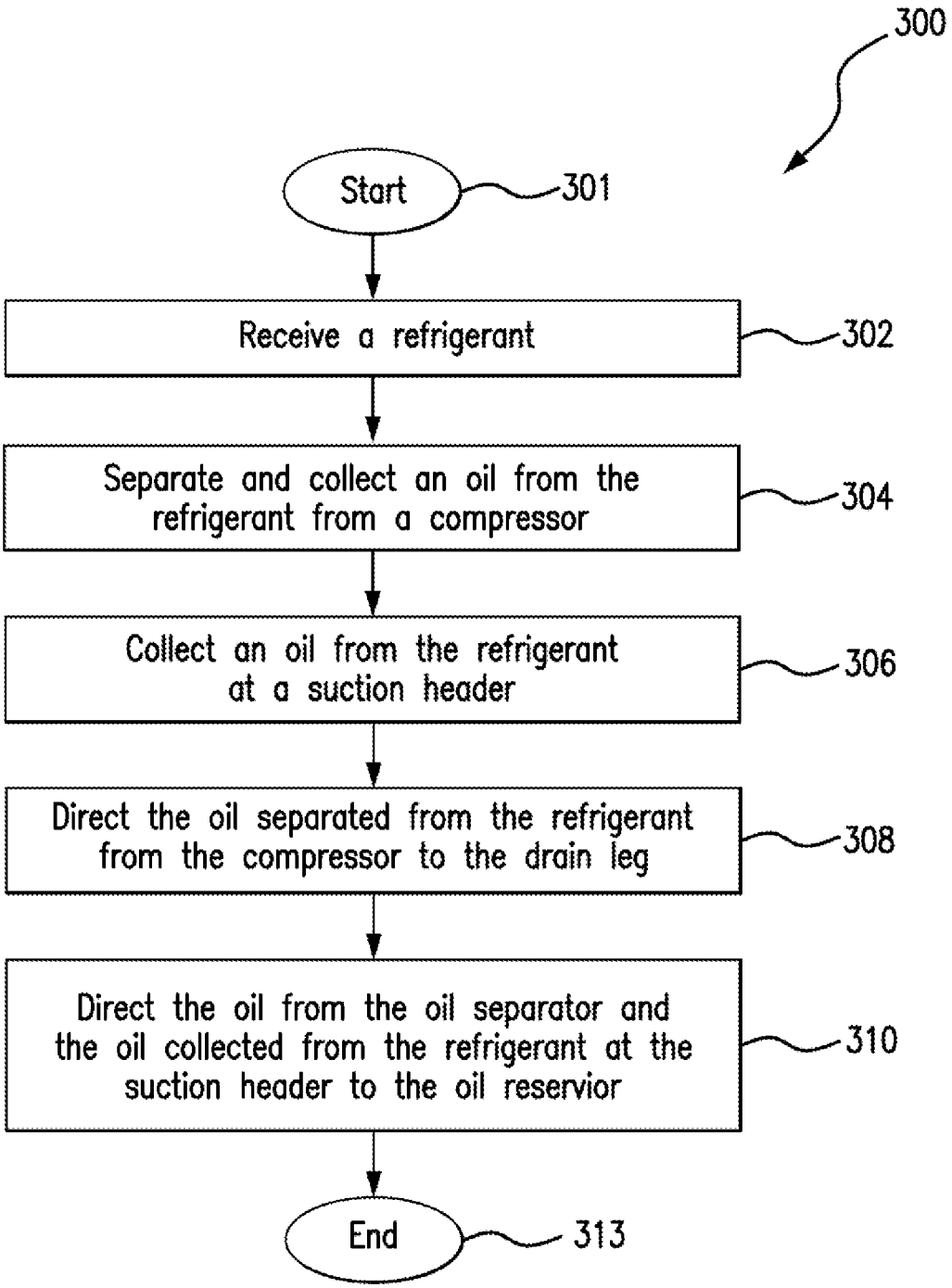
FIG. 3 is a flowchart illustrating a method for operating the cooling system of FIG. 2.

Embodiments of the present disclosure and its advantages are best understood by referring to FIGS. 1 through 3 of the drawings, like numerals being used for like and corresponding parts of the various drawings.

A typical commercial refrigeration system includes a suction header, a compressor, an oil separator, and an oil reservoir. Compressors compress refrigerant to concentrate the heat that has been absorbed as spaces have been cooled, making it easier for this heat to be removed from the system. Compressors typically have oiled components. Oil enters the compressor in an uncontrolled manner though the suction header. Oil also enters the compressor in a controlled manner from oil reservoir, as needed. However, a problem occurs when the oil returns to the compressor from the suction header faster than it is used by the compressor. As a result, oil mixes with the refrigerant and is cycled through the other components of the system. This can shorten the lifespan of the system. To help remedy this issue, some systems use a high efficiency oil separator in lieu of just a standard efficiency separator to separate the oil from the refrigerant. Oil separators receive refrigerant from the compressor and separate oil that may have mixed with the refrigerant in the compressor. By separating the oil from the refrigerant, the oil separator protects other components of the system from being clogged and/or damaged by the oil. The oil that is removed by the separator is collected into the reservoir. The oil may then be added back to the compressor. However, the oil separator does not remove all the oil from the refrigerant and so some oil reaches the other components of the system. This can damage the other components and shorten the lifespan of the system.

For example, FIG. 1 illustrates an example cooling system 100. As shown in FIG. 1, system 100 includes suction header 102, compressor 104, oil separator 106, oil reservoir 108, high side heat exchanger 110, and load 112.

High side heat exchanger 110 removes heat from the system. When heat is removed from the refrigerant, the refrigerant is cooled. This disclosure contemplates high side heat exchanger 110 being operated as a condenser and/or a gas cooler. When operated as a condenser, high side heat exchanger 110 cools the refrigerant such that the state of the refrigerant changes from a gas to a liquid. When operating as a gas cooler, high side heat exchanger 110 cools gaseous and/or supercritical refrigerant and the refrigerant remains a gas and/or a supercritical fluid. In certain configurations, high side heat exchanger 110 is positioned such that heat removed from the refrigerant may be discharged into the air. For example, high side heat exchanger 110 may be positioned on a rooftop so that heat removed from the refrigerant may be discharged into the air. As another example, high side heat exchanger 110 may be positioned external to a building and/or on the side of a building.

Load 112 receives refrigerant from high side heat exchanger 110 and uses the refrigerant to remove heat from the air around load 112. As a result, the air is cooled. The cooled air may then be circulated such as, for example, by a fan to cool a space such as, for example, a freezer and/or a refrigerated shelf. As the refrigerant passes through load 112, the refrigerant may change from a liquid state to a gaseous state as it absorbs heat.

After leaving load 112, the refrigerant is received by suction header 102 and directed to compressor 104. Compressor 104 compresses the refrigerant, concentrating the heat in the refrigerant and making it easier for high side heat exchanger 110 to remove. Although FIG. 1 depicts only one compressor 104, this disclosure contemplates system 100 including any number of compressors.

Oil separator 106 receives refrigerant from compressor 104. Oil separator 106 separates oil that may have mixed with the refrigerant. The oil may have mixed with the refrigerant in compressor 104. By separating the oil from the refrigerant, oil separator 106 protects other components of system 100 from being clogged and/or damaged by the oil. Oil reservoir 108 may collect and store the separated oil. The separated oil may then be returned as needed to compressor 104, which has oiled components. Refrigerant is directed to high side heat exchanger 110 after leaving oil separator 106. Oil that is not captured by the oil separator 106 continues through the high side heat exchanger 110 and the load 112 and collects in the suction header 102 where it is metered back into the compressor 104. This metering process is uncontrolled and the oil is fed to the compressor whether it needs it or not.

A problem occurs in system 100 when oil separator 106 is unable to remove enough oil from the refrigerant, and oil feeds to the compressor 104 from the suction header 102 at too fast a rate. This disclosure contemplates an unconventional oil recovery system that includes a drain leg that uses gravity to separate and collect excess oil from the refrigerant in the suction header. As a result, additional oil is removed from the refrigerant, which improves the lifespan of the system.

Certain embodiments of the oil recovery system will be described in more detail using FIGS. 2 and 3. FIG. 2 illustrates a design for the system. FIG. 3 shows a process for operating the system.

FIG. 2 illustrates an example cooling system 200. As seen in FIG. 2, system 200 includes suction header 102, compressor 104, and oil separator 106. Additionally, system 200 includes drain leg 202, drain valve 204, check valve 206, oil level sensor 208, valve 210, and oil reservoir 108. Generally, system 200 allows for drain leg 202 to use gravity to separate and collect excess oil from the refrigerant cycling through compressor 104. As a result, additional oil is removed from the refrigerant, which improves the lifespan of the system.

Suction header 102, compressor 104, oil separator 106, and oil reservoir 108 operate similarly as they did in system 100. For example, suction header 102 receives oil from oil separator 106 and receives oil from compressor 104 when compressor 104 has made use of the oil, compressor 104 compresses a refrigerant, oil separator 106 separates oil from refrigerant, and oil reservoir 108 collects and stores oil.

System 200 also includes drain leg 202. Drain leg 202 is coupled to suction header 102 via drain valve 204 and extends below suction header 102. As refrigerant flows through suction header 102, oil that is not separated from the refrigerant by oil separator 106 flows via gravity into drain leg 202, where it is collected. As a result, excess oil is removed from the refrigerant cycling through system 200 and does not continue to cycle with the refrigerant thereby preventing or reducing damage caused by the oil on other components of system 200. To prevent drain leg 202 from overflowing, drain leg 202 is also coupled to oil reservoir 108 via check valve 206. Oil that has been collected in drain leg 202 may be flushed to oil reservoir 108 using oil from oil separator 106. Drain leg 202 may be any suitable conduit, such as, for example, metal or PVC piping.

Drain valve 204 is coupled to suction header 102 and drain leg 202. Drain valve 204 controls the flow of refrigerant and oil from suction header 102 to drain leg 202. Drain valve 204 may be any suitable type of valve, such as a solenoid valve. When drain valve 204 is in an open position, refrigerant and oil can flow from suction header 102 to drain leg 202. The oil may be pulled downwards into drain leg 202 by gravity, and the gaseous refrigerant may remain near suction header 102 and be pulled into compressor 104. When drain valve 204 is in a closed position, refrigerant and oil cannot flow from suction header 102 to drain leg 202. Drain leg 202 may be flushed using the oil from oil separator 106 when drain valve 204 is closed.

Check valve 206 is located at the bottom of drain leg 202 and is coupled to drain leg 202 and oil reservoir 108. Check valve 206 controls the flow of oil from drain leg 202 to oil reservoir 108. For example, check valve 206 may allow oil to flow when the pressure of the oil is higher than a particular threshold set for check valve 206. If the pressure of the oil is not sufficiently high, then check valve 206 prevents the oil from flowing through check valve 206. When the pressure of the oil in drain leg 202 is sufficiently high, the oil flows through check valve 206 to oil reservoir 108, thus draining the oil that has collected in drain leg 202. When the pressure of the oil in drain leg 202 is not sufficiently high, the oil does not flow through check valve 206 and instead, collets in drain leg 202. In certain embodiments, check valve 206 and oil reservoir 108 may be connected via any suitable conduit. As used herein, check valve 206 and oil reservoir 108 are connected via tubing through which the oil travels.

Oil level sensor 208 detects a level of oil collected by drain leg 202. This disclosure contemplates oil level sensor 208 being any suitable sensor. For example, oil level sensor 208 may be a sensor that detects the height, volume, and/or weight of the oil that has been collected by drain leg 202. As another example, sensor 208 may be positioned at a certain height on drain leg 202 and trigger when it contacts oil collected in drain leg 202. If the level of oil collected by drain leg 202 exceeds a threshold, system 200 transitions from the drain mode to the transfer mode. For example, if the threshold level of oil is five inches and oil level sensor 208, which is a sensor that detects the height of oil in drain leg 202, detects an oil height of five and a half inches, system 200 will transition from the drain mode to the transfer mode. As a result, system 200 will transition from the drain mode to the transfer mode before the oil in drain leg 202 flows back into suction header 102.

Valve 210 is coupled to oil separator 106 and drain leg 202 and controls the flow of oil from oil separator 106 to drain leg 202. Valve 210 may be any suitable type of valve, such as a solenoid valve. When valve 210 is in an open position, oil flows from oil separator 106 to drain leg 202 allowing drain leg 202 to be flushed by the oil in oil separator 106. For example, the oil flowing from oil separator 106 to drain leg 202 may increase the pressure of the oil in drain leg 202. When the pressure of the oil exceeds a threshold set for check valve 206, the oil flows through check valve 206 to oil reservoir 108, thus flushing drain leg 202. Alternatively, when valve 210 is in a closed position, oil does not flow from oil separator 106 to drain leg 202 allowing drain leg 202 to collect oil from suction header 102. In certain embodiments, valve 210 and drain leg 202 may be connected via any suitable conduit. As used herein, valve 210 and drain leg 202 are connected via tubing through which the oil travels.

Oil reservoir 108 collects the oil that has been flushed from drain leg 202 and directs oil to compressor 104 in a controlled manner, returning oil to the system as needed. Oil reservoir 108 is coupled to drain leg 202 via check valve 206. In certain embodiments, check valve 206 and oil reservoir 108 may be connected via any suitable conduit. As used herein, check valve 206 and oil reservoir 108 are connected via tubing through which the oil travels. Oil reservoir 108 is also coupled to compressor 104. In certain embodiments, oil reservoir 108 and compressor 104 may be connected via any suitable conduit. As used herein, oil reservoir 108 and compressor 104 are connected via tubing through which the oil travels.

In certain embodiments, to remove additional oil from the refrigerant cycling through the components of system 200, which improves the lifespan of system 200, oil separator 106 is configured to operate according to a drain mode. During the drain mode, oil from compressor 104 that has collected in suction header 102 drains into and is collected by drain leg 208 (e.g., via gravity). During a transfer mode, oil from oil separator 106 is used to flush the oil from drain leg 202 to oil reservoir 108.

During the drain mode, drain valve 204 is in an open position to direct oil from the refrigerant cycling through compressor 104 that has collected in suction header 102 to drain leg 202. Drain leg 202 collects the oil from the refrigerant cycling through compressor 104 that has collected in suction header 102. As a result, excess oil is removed from the refrigerant. Furthermore, valve 210 is in a closed position to isolate oil separator 106 from drain leg 202 and prevent oil from oil separator 106 from flowing into drain leg 202. To ensure that drain leg 202 does not overflow with oil during the drain mode, oil level sensor 208 detects a level of oil collected by drain leg 202. For example, if the level of oil in drain leg 202 exceeds a threshold, system 200 will transition from the drain mode to the transfer mode so oil is flushed from drain leg 202.

During the transfer mode, valve 210 is in an open position to direct oil from oil separator 106 to drain leg 202. As a result, the pressure of the oil in drain leg 202 increases so that it can flow through check valve 206 to oil reservoir 108. This allows for the oil from oil separator 106 to flush the oil collected in drain leg 202. To isolate suction header 102 from drain leg 202, and thus prevent any oil from flowing back to suction header 102, drain valve 204 is in a closed position. As the oil from oil separator 106 moves through drain leg 202 it sweeps the oil that drained into drain leg 202 through check valve 206, which directs the oil to oil reservoir 208. As a result, the oil in drain leg 202 is flushed.

In certain embodiments, system 200 operates according to the drain mode for a first period of time, after which system 200 transitions to the transfer mode. After operating at the transfer mode for a second period of time, the second period of time being shorter than the first period of time, system 200 transitions back to the drain mode. As a result, system 200 may transition from periods of collecting oil in drain leg 202 to periods of removing the oil collected in drain leg 202, along with oil from oil separator 106, to oil reservoir 108. In this manner, the transition from drain mode to transfer mode, and vice versa, is not completely dependent on a certain amount or a certain level of oil having been collected in drain leg 202.

FIG. 3 is a flowchart illustrating a method 300 for operating the cooling system 200 of FIG. 2. In particular embodiments, various components of system 200 perform the steps of method 300. By performing method 300, additional oil is removed from the refrigerant, which improves the lifespan of the system A suction header receives a refrigerant in step 302. In step 304, an oil separator separates and collects an oil from the refrigerant from a compressor. Beginning in step 306, the oil separator operates according to a first mode of operation. In step 306, the drain leg collects an oil from the refrigerant at the suction header. In step 308, the oil separator transitions from the first mode of operation to a second mode of operation. In step 308, the oil separator directs the oil separated from the refrigerant from the compressor to the drain leg. The drain leg directs the oil from the oil separator and the oil collected from the refrigerant at the suction header to the oil reservoir.

Modifications, additions, or omissions may be made to method 300 depicted in FIG. 3. Method 300 may include more, fewer, or other steps. For example, steps may be performed in parallel or in any suitable order. While discussed as system 200 (or components thereof) performing the steps, any suitable component of system 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a conduit coupled to a suction header that is configured to receive a refrigerant; and an oil separator that is configured to separate an oil from the refrigerant received from a compressor;

wherein during a first mode of operation, the conduit is configured to remove excess oil from the refrigerant that has collected at the suction header;

wherein during a second mode of operation, the oil separator is configured to direct to the conduit the oil separated from the refrigerant received from the compressor; and wherein the conduit is configured to direct to an oil reservoir the oil from the oil separator and the excess oil removed from the refrigerant.

2. The apparatus of claim 1, further comprising a drain valve coupled to the suction header and the conduit, wherein the drain valve is configured to:

in the first mode of operation, be in an open position to direct oil from the suction header to the conduit; and in the second mode of operation, be in a closed position to isolate the suction header from the conduit.

3. The apparatus of claim 2, wherein the drain valve is further configured to close during the first mode of operation if a temperature of the refrigerant falls below a threshold.

4. The apparatus of claim 1, further comprising a check valve coupled to the conduit, wherein the check valve is configured to:

in the first mode of operation, be in a closed position; and in the second mode of operation, be in an open position to direct the oil from the oil separator and the oil collected from the refrigerant at the suction header to the oil reservoir.

5. The apparatus of claim 1 configured to:

transition from the first mode of operation to the second mode of operation after a first period of time; and transition from the second mode of operation to the first mode of operation after a second period of time, the second period of time shorter than the first period of time.

6. The apparatus of claim 1, further comprising an oil level sensor that is configured to detect a level of oil collected by the conduit, wherein the apparatus is configured to transition from the first mode of operation to the second mode of operation when the detected level of oil exceeds a threshold.

7. The apparatus of claim 1, further comprising a valve coupled to the oil separator, wherein the valve is configured to be closed during the first mode of operation and open during the second mode of operation to direct the oil from the oil separator to the conduit.

8. A system comprising:

a high side heat exchanger that is configured to remove heat from a refrigerant;

a load that is configured to use the refrigerant from the high side heat exchanger to cool a space proximate the load;

a conduit coupled to a suction header that is configured to receive a refrigerant;

an oil separator that is configured to separate an oil from the refrigerant received from a compressor;

wherein during a first mode of operation, the conduit is configured to remove excess oil from the refrigerant that has collected at the suction header;

wherein during a second mode of operation, the oil separator is configured to direct to the conduit the oil separated from the refrigerant received from the compressor; and wherein the conduit is configured to direct to an oil reservoir the oil from the oil separator and the excess oil removed from the refrigerant.

9. The system of claim 8, further comprising a drain valve coupled to the suction header and the conduit, wherein the drain valve is configured to:

in the first mode of operation, be in an open position to direct oil from the suction header to the conduit; and in the second mode of operation, be in a closed position to isolate the suction header from the conduit.

10. The system of claim 8, wherein the drain valve is further configured to close during the first mode of operation if a temperature of the refrigerant falls below a threshold.

11. The system of claim 8, further comprising a check valve coupled to the conduit, wherein the check valve is configured to:

in the first mode of operation, be in a closed position; and in the second mode of operation, be in an open position to direct the oil from the oil separator and the oil collected from the refrigerant at the suction header to the oil reservoir.

12. The system of claim 8, configured to:

transition from the first mode of operation to the second mode of operation after a first period of time; and transition from the second mode of operation to the first mode of operation after a second period of time, the second period of time shorter than the first period of time.

13. The system of claim 8, further comprising an oil level sensor that is configured to detect a level of oil collected by the conduit, wherein the system is configured to transition from the first mode of operation to the second mode of operation when the detected level of oil exceeds a threshold.

14. The system of claim 8, further comprising a valve coupled to the oil separator, wherein the valve is configured to be closed during the first mode of operation and open during the second mode of operation to direct the oil from the oil separator to the conduit.

15. A method comprising:

receiving, by a suction header, a refrigerant;

separating, by an oil separator, an oil from the refrigerant received from a compressor; and during a first mode of operation, removing, by a conduit, excess oil from the refrigerant that has collected at the suction header; and during a second mode of operation, directing to the conduit, by the oil separator, the oil separated from the refrigerant received from the compressor; and directing to an oil reservoir, by the conduit, the oil from the oil separator and the excess oil removed from the refrigerant.

16. The method of claim 15, further comprising:

in the first mode of operation, opening a drain valve coupled to the suction header and the conduit to direct oil from the suction header to the conduit; and in the second mode of operation, closing the drain valve to isolate the suction header from the conduit.

17. The method of claim 15, further comprising closing the drain valve during the first mode of operation if a temperature of the refrigerant falls below a threshold.

18. The method of claim 15, further comprising:

in the first mode of operation, closing a check valve coupled to the conduit; and in the second mode of operation, opening the check valve to direct the oil from the oil separator and the oil collected from the refrigerant at the suction header to the oil reservoir.

19. The method of claim 15, further comprising:

transitioning from the first mode of operation to the second mode of operation after a first period of time; and transitioning from the second mode of operation to the first mode of operation after a second period of time, the second period of time shorter than the first period of time.

20. The method of claim 15, further comprising:

detecting, by an oil level sensor, the level of oil collected by the conduit; and transitioning from the first mode of operation to the second mode of operation when the detected level of oil exceeds a threshold.

* * * * *